US009236026B2

(12) United States Patent
Jia et al.

(10) Patent No.: US 9,236,026 B2
(45) Date of Patent: Jan. 12, 2016

(54) COLOR TEMPERATURE TUNING METHOD, COLOR TEMPERATURE TUNING APPARATUS AND DISPLAY APPARATUS

(71) Applicants: BEIJING BOE DISPLAY TECHNOLOGY CO., LTD., Beijing (CN); BOE TECHNOLOGY GROUP CO., LTD., Beijing (CN)

(72) Inventors: Lili Jia, Beijing (CN); Xiuyun Chen, Beijing (CN); Lingyu Sun, Beijing (CN); Hongli Zhu, Beijing (CN); Yu Zhang, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 20 days.

(21) Appl. No.: 14/236,217

(22) PCT Filed: May 27, 2013

(86) PCT No.: PCT/CN2013/076266

§ 371 (c)(1),
(2) Date: Jan. 30, 2014

(87) PCT Pub. No.: WO2014/153828

PCT Pub. Date: Oct. 2, 2014

(65) Prior Publication Data

US 2014/0292837 A1 Oct. 2, 2014

(30) Foreign Application Priority Data

Mar. 27, 2013 (CN) ..... 2013 1 0101459

(51) Int. Cl.
*G09G 5/06* (2006.01)
*G09G 3/34* (2006.01)

(52) U.S. Cl.
CPC ..... *G09G 5/06* (2013.01); *G09G 3/3413* (2013.01); *G09G 2320/0666* (2013.01)

(58) Field of Classification Search
CPC ..... G09G 5/02; G09G 5/06; G09G 3/3413; G09G 2320/0233; G09G 2320/0242; G09G 2320/0666; H04N 9/73; G02F 1/133602; G02F 1/133603
USPC ..... 345/63, 77, 88, 589, 591, 600, 690; 348/E9.051; 358/518
See application file for complete search history.

(56) References Cited

U.S. PATENT DOCUMENTS

2003/0020736 A1* 1/2003 Kimura et al. ..... 345/690
2005/0078079 A1* 4/2005 Hashimoto ..... 345/100

(Continued)

FOREIGN PATENT DOCUMENTS

CN 101206839 A 6/2008
CN 102404918 A 4/2012
CN 102762008 A 10/2012

OTHER PUBLICATIONS

International Search Report mailed Feb. 1, 2014; PCT/CN2013/076266.
Dong-Ling Chen, et al; "Study on Method of Adjusting Color Temperature Continuously Based on Three Primary Lighting Sources", Jisuanji Yu Xiandaihua; pp. 179-182; Jun. 30, 2012.

(Continued)

*Primary Examiner* — Tom Sheng
(74) *Attorney, Agent, or Firm* — Ladas & Parry LLP

(57) ABSTRACT

Embodiments of the present invention relate to a color temperature tuning method, a color temperature tuning apparatus, and a display apparatus. The color temperature tuning method includes the steps of: matching an input color temperature signal with a color temperature value in the color temperature lookup table, and extracting a current signal corresponding to the color temperature value matching with the input color temperature signal from the color temperature lookup table; and controlling a light emitting device to emit light according to the current signal. According to embodiments of the present invention, intermediate calculation process is omitted and time for tuning the color temperature is shorten. Currents flowing through the blue and green light emitting elements are controlled to emit lights to excite red fluorescent powder, so that the LED emits lights having various color temperatures, and tuning accuracy of the color temperature and user experience are improved.

18 Claims, 3 Drawing Sheets

(56) References Cited

U.S. PATENT DOCUMENTS

| | | | | |
|---|---|---|---|---|
| 2007/0120808 | A1* | 5/2007 | Shimoda et al. | 345/102 |
| 2008/0151965 | A1 | 6/2008 | Kim | |
| 2009/0243504 | A1 | 10/2009 | Cho et al. | |
| 2010/0225848 | A1* | 9/2010 | Adachi | 349/61 |
| 2012/0038286 | A1* | 2/2012 | Hasnain | 315/250 |
| 2012/0038291 | A1* | 2/2012 | Hasnain | 315/294 |
| 2012/0098460 | A1* | 4/2012 | Miyasaka et al. | 315/294 |
| 2012/0313979 | A1* | 12/2012 | Matsuura | 345/690 |
| 2013/0010155 | A1* | 1/2013 | Hamada | 348/223.1 |
| 2013/0134900 | A1* | 5/2013 | Liang et al. | 315/292 |

OTHER PUBLICATIONS

An-Xiang Wang, et al; "Study on the calculating methods for correlated color temperature of light source", Xian Engineering Technology Academic Transaction; pp. 490-493, period 5 of roll 20; Aug. 31, 2006.

First Chinese Office Action dated Sep. 2, 2014; Appln. No. 201310101459.6.

Second Chinese Office Action Appln. No. 201310101459; Dated Jan. 29, 2015.

International Preliminary Report on Patentability dated Sep. 29, 2015; PCT/CN2013/076266.

* cited by examiner

COLOR TEMPERATURE TUNING METHOD, COLOR TEMPERATURE TUNING APPARATUS AND DISPLAY APPARATUS

TECHNICAL FIELD

Embodiments of the present invention relate to a color temperature tuning method, a color temperature tuning apparatus, and a display apparatus.

BACKGROUND

People have various demands for liquid crystal TV and display in terms of color. However, color spaces of conventional displays and liquid crystal TVs are limited. Color temperature tuning in conventional displays is implemented generally by an accurate color capture (ACC) tuning method. The ACC tuning method is performed by software and may achieve a tuning range of several hundreds Kelvin.

The ACC tuning is performed by software processing. In general, in the case of inputting a gray scale signal of 8 bits, the 8 bits signal is changed into a 9 bits signal using an interpolation by software processing, and eventually outputted as an 8 bits signal or 6 bits signal. In the ACC tuning method, the interpolation is performed based on a certain tuning direction when the 8 bits signal is changed into the 9 bits signal, and values useful for color temperature tuning are remained during outputting the 8 bits signal. By doing this, the gray scale signal of 8 bits is changed, thus achieving color temperature tuning. The ACC tuning method usually has a limited tuning range of several hundreds Kelvin and thus performs supplementary tuning for color temperature. The limited tuning range directly affects the accuracy of display effect and user experience.

SUMMARY

Embodiments of the present invention provide a color temperature tuning method. The color temperature tuning method comprises following steps of: S1: matching a input color temperature signal with a color temperature value in a color temperature lookup table, and extracting a current signal corresponding to the color temperature value matching with the input color temperature signal from in the color temperature lookup table; and S2: controlling a light emitting device to emit light according to the current signal.

Before the step S1, the method further comprises a step of S0: establishing a color temperature lookup table.

The step S0 comprises steps of: S01: establishing a calculation formula of a relationship between the current and the color temperature value by controlling the current applied to the light emitting device and measuring color temperature value corresponding to the current; and S02: establishing the color temperature lookup table according to the calculation formula.

The calculation formula is:

$$T(k)=[t_6\times k^6-t_5\times k^5+t_4\times k^4-t_3\times k^3+t_2\times k^2-t_1\times k+t_0],$$

where k denotes a ratio of a current flowing through a green light emitting element of the light emitting device to a current flowing through a blue light emitting element of the light emitting device, $k=I(G_{chip}):I(B_{chip})$, $0.25\leq k\leq 2$, $t_0$~$t_6$ denotes coefficient of 0-6 order exponentials of k, $I(G_{chip})$ denotes a current flowing through the green light emitting element, $I(B_{chip})$ denotes current flowing through the blue light emitting element, and T(k) denotes the color temperature value corresponding to k.

Embodiments of the present invention provide a color temperature tuning apparatus for performing the above mentioned color temperature tuning method. The color temperature tuning apparatus comprises: a color temperature controlling device for controlling the input color temperature signal and a light emitting device for emitting light according an output signal of the color temperature controlling device. The color temperature controlling device is connected with the light emitting device.

The color temperature controlling device comprises: a signal receiving unit for receiving the color temperature signal; a color temperature lookup table unit for matching the color temperature signal with the color temperature value in the color temperature lookup table; a color temperature selection unit for selecting the color temperature value proximal to the color temperature signal from the color temperature lookup table; and a first power supply unit for supplying power to the signal receiving unit, the color temperature lookup table unit and the color temperature selection unit.

The signal receiving unit is connected with the color temperature lookup table unit, the color temperature lookup table unit is connected with the color temperature selection unit, and the color temperature selection unit is connected with the light emitting device, the first power supply unit is connected with the signal receiving unit, the color temperature lookup table unit, and the color temperature selection unit, respectively.

The light emitting device comprises: a current controlling unit for controlling current according to the output signal of the color temperature selection unit; a light emitting unit for emitting light according to the output signal of the current controlling unit; and a second power supply unit for supplying power to the current controlling unit and the light emitting unit.

The current controlling unit is connected with the color temperature selection unit and the light emitting unit, respectively, the second power supply unit is connected with the current controlling unit and the light emitting unit, respectively.

The second power supply comprises a first current output terminal and a second current output terminal.

The light emitting unit is a LED.

The LED comprises a blue light emitting element for emitting blue light and a green light emitting element for emitting green light, the blue light emitting element and the green light emitting element are connected with the first current output terminal and the second current output terminal, respectively.

The LED comprises red fluorescent powder coated on the green light emitting element and blue light emitting element.

Embodiments of the present invention provide a display apparatus comprising the above mentioned color temperature tuning apparatus.

DETAILED DESCRIPTION

Figure 1:
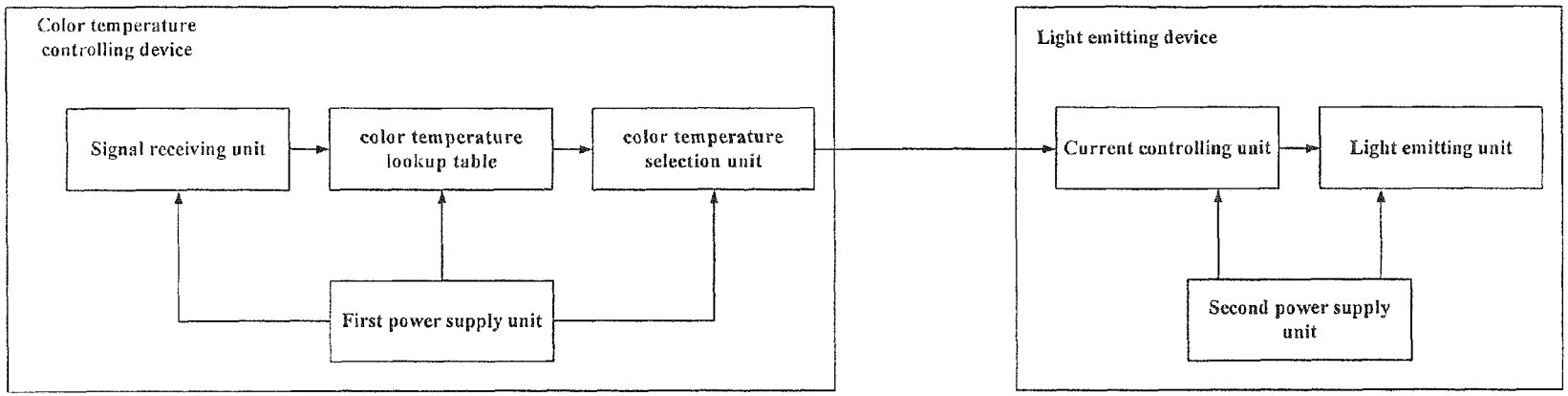
FIG. 1 is a structural schematic view of an apparatus according to an embodiment of the present invention.

In order to make objects, technical solutions and advantages of the embodiments of the invention apparent, the technical solutions of the embodiment will be described clearly and fully in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention. Hereinafter, various exemplary embodiments are described in detail with reference to the accompanying drawings. Obviously, the following embodiments are used to explain the present invention, and are not intended to limit the present invention.

In order to solve the problem of small tuning range of color temperature and low accuracy of liquid crystal TV and display, embodiments of the present embodiment provide a color temperature tuning method. The method comprises following steps of S0, S1 and S2.

S0: creating a color temperature lookup table.

The step of S0 comprises following steps.

S01: establishing a calculation formula of relationship between a current and color temperature by controlling the current applied on light emitting devices in display apparatus and measuring color temperature of the display apparatus corresponding to the current. Such formula is obtained using a green light emitting element, a blue light emitting element and a color temperature detecting device in experiments.

The calculation formula is as follows:

$$T(k)=[t_6\times k^6-t_5\times k^5+t_4\times k^4-t_3\times k^3+t_2\times k^2-t_1\times k+t_0]$$

Here, k denotes a ratio of the current flowing through the green light emitting element to the current flowing through the blue light emitting element, $k=I(G_{chip}):I(B_{chip})$, $0.25\leq k\leq 2$, $t_0$~$t_6$ denotes coefficients of 0-6 order exponentials of k, $I(G_{chip})$ denotes the current flowing through the green light emitting element, $I(B_{chip})$ denotes the current flowing through the blue light emitting element, and T(k) denotes the color temperature corresponding to k.

S02: establishing color temperature lookup table according to the calculation formula.

Color temperature lookup table is a table consisting of color temperature and the ratio of the current flowing through the green light emitting element to, the current flowing through the blue light emitting element.

S1: looking up the color temperature lookup table with an input color temperature signal, for example, by comparing the input color temperature signal with the color temperature value in the color temperature lookup table; extracting the current signal matching with the input color temperature signal from the color temperature lookup table; and sending the current signal corresponding to the color temperature value in the color temperature lookup table matching with the input color temperature signal to the light emitting devices.

S2: controlling the light emitting device to emit lights based on the current signal.

Based on the current signal, the corresponding currents are applied to the green light emitting element and blue light emitting element of the light emitting device to emit light, respectively, thus controlling color temperature.

Color temperature tuning apparatus according to an embodiment of the present invention is shown in FIG. 1. The color temperature tuning apparatus comprises a color temperature controlling device for controlling the input color temperature signal and a light emitting device for emitting light according the output signal of the color temperature controlling device. The color temperature controlling device is connected with the light emitting device.

The color temperature controlling device comprises: a signal receiving unit for receiving the color temperature signal; a color temperature lookup table unit for matching the color temperature signal with the color temperature value in the color temperature lookup table; a color temperature selection unit for selecting a color temperature value proximate to the color temperature signal; and a first power supply unit for supplying power to the signal receiving unit, the color temperature lookup table unit and the color temperature selection unit.

The signal receiving unit is connected with the color temperature lookup table unit, the color temperature lookup table unit is connected with the color temperature selection unit, and the color temperature selection unit is connected with the light emitting device. The first power supply unit is connected with the signal receiving unit, the color temperature lookup table unit, and the color temperature selection unit, respectively.

The light emitting device comprises: a current controlling unit for controlling current based on the output signal of the color temperature selection unit; a light emitting unit for emitting light according to the output signal of the current controlling unit; and a second power supply unit for supplying power to the current controlling unit and the light emitting unit. The light emitting unit can comprise LEDs for example The current controlling unit is connected with the color temperature selection unit and the light emitting unit, respectively. The second power supply unit is connected with the current controlling unit and the light emitting unit, respectively. The second power supply comprises a first current output terminal and a second current output terminal.

The LEDs comprises a blue light emitting element for emitting blue light and a green light emitting element for emitting green light. A large tuning range of color temperature can be achieved by the blue light emitting element and the green light emitting element. The blue light emitting element and the green light emitting element are connected with the first current output terminal and the second current output terminal, respectively. The light emitting elements according to embodiments of the present invention can be formed by Indium Gallium nitride (InGaN) and sapphire, for example. The light emitting elements can be coated with red fluorescent powder.

An embodiment of the present invention further provides a display apparatus comprising the above mentioned color temperature tuning apparatus.

The light emitting device according to the embodiment of the present invention can comprise a blue light emitting element, a green light emitting element and red fluorescent powder. The red fluorescent powder is excited by the lights emitted from the green light emitting element and the blue light emitting element, thus the light emitting device is a white LED based on RGB primary colors. Various color temperatures can be achieved by controlling a color temperature preset module in a color temperature controlling system so as to meet the various demands of different fields for warm or cold color tones and color representation.

Figure 2:
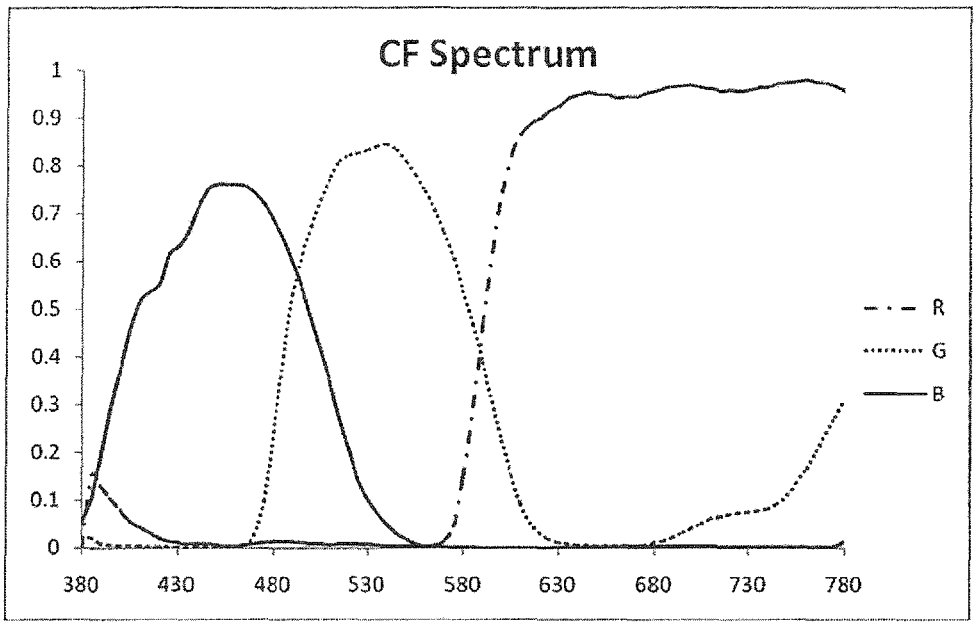
FIG. 2 is a spectrum diagram of a color filter.

The color temperature signal is transmitted to the color temperature preset module and compared with the preset color temperature value stored in the color temperature preset module of the color temperature controlling device. After creating the lookup table of the preset color temperatures, a ratio of driving current of the blue light emitting element to driving current of the green light emitting element stored in the lookup table for generating the preset color temperature is extracted. Based on the ratio of driving currents determined as above, a circuit controlling system on a system board modulates the currents flowing through the blue light emitting element and the green light emitting element respectively so as to tune colors. Color filter spectrum with different ratios of blue light to green light is shown in FIG. 2.

The color temperature tuning apparatus may comprise two circuit parts of a LED driving circuit part and a liquid crystal panel circuit part. The color temperature tuning apparatus may be located on a main board of a display. Alternatively, the color temperature tuning apparatus may be integrated directly on the liquid crystal panel circuit part.

Figure 3:
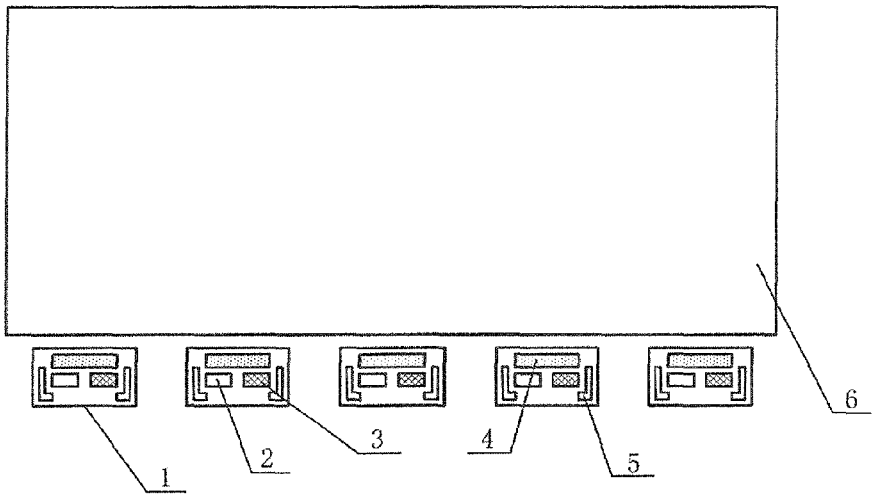
FIG. 3 is a structural schematic view of a side-type back light unit according to an embodiment of the present invention.
Figure 4:
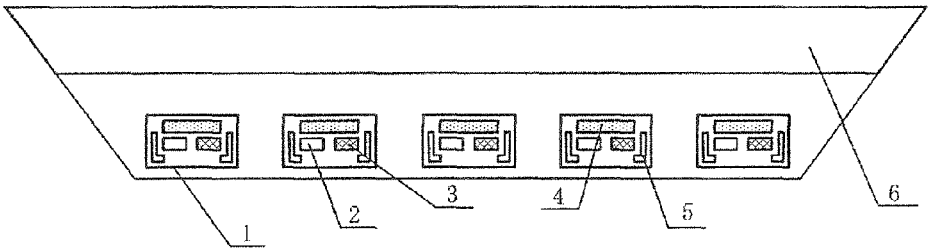
FIG. 4 is a structural schematic view of a direct-type back light unit according to an embodiment of the present invention.

Back light unit (BLU) may be a side-type (as shown in FIG. 3) or direct-type (as shown in FIG. 4) back light unit comprising a blue light emitting element and a green light emitting element. Taking FIG. 3 as an example, lights emitted from a LED 1 are transmitted through the light guiding unit 6 and supplied to the display apparatus. Different currents are supplied to the blue light emitting element 2 and the green light emitting element 3 by controlling output current, and lights having different color temperatures can be obtained after transmitting through the red fluorescent powder. The resultant light is changed into a surface light source after going through the light guide unit 6. The blue light emitting element 2 and the green light emitting element 3 are fixed via a fixing sheet 5.

The color temperature and the ratio of the current of the green light emitting element to the current of the blue light emitting element satisfy the following weighted equation:

$$T(k)=[t_6\times k^6-t_5\times k^5+t_4\times k^4-t_3\times k^3+t_2\times k^2-t_1\times k+t_0]$$

$$k=I(G_{chip}):I(B_{chip}),(0.25\leq k\leq 2)$$

Here, $t_0$~$t_6$ denotes coefficients of 0-6 order exponentials of k, $I(G_{chip})$ denotes a current flowing through the green light emitting element, $I(B_{chip})$ denotes a current flowing through the blue light emitting element, k denotes a ratio of the current flowing through the green light emitting element to the current flowing through the blue light emitting element; $k=I(G_{chip}):I(B_{chip})$, $0.25\leq k\leq 2$, and T(k) denotes color temperature corresponding to k.

An embodiment is as following.

$$T(k)=[25769k^6-202987k^5+641159k^4-1036156k^3+902824k^2-405798k+83876]$$

$$k=I(G_{chip}):I(B_{chip}),(0.25\leq k\leq 2)$$

Here, values of $t_0$~$t_6$ are measured by experiments. T(0.25)=24975, T(0.465)=12036, T(0.6)=10116, T(1)=8687, T(1.6)=7492, T(2)=6504.

According to embodiments of the present invention, color temperature T may be tuned in a range of 6500K~25000K. Tuning range demanded by a liquid crystal panel is usually in a range of 6500K~12000K. Therefore, methods according to embodiments of the present invention may meet the demands of the liquid crystal panel for color temperature tuning.

As the ratio k ($0.25\leq k\leq 2$) of the current of the green light emitting element to the current of the blue light emitting element increases, color temperature reduces.

According to embodiments of the present invention, color temperature lookup table is established according to the calculation formula of the current and color temperature, and the parameter range in the color temperature lookup table may be set based on the demand, thus the range of the color temperature can be extended.

According to embodiments of the present invention, color temperature signal is looked up in the color temperature lookup table, thus intermediate calculation process is omitted and time for tuning the color temperature is shorten.

According to embodiments of the present invention, the currents of the blue light emitting element and the green light emitting element are controlled to emit lights to excite red fluorescent powder, so that the LED emits lights having various color temperatures, and tuning accuracy of the color temperature and user experience are improved.

The foregoing description is merely the exemplary embodiments of the present invention, and is not intended to limit the present invention. Various modifications and variations can be made for the skilled in the art and fall into the protection scope of the present invention without departing technical principle of the present invention.

What is claimed is:

1. A color temperature tuning method, comprising following steps of:

S1: matching a input color temperature signal with a color temperature value in a color temperature lookup table, and extracting a current signal corresponding to the color temperature value matching with the input color temperature signal from in the color temperature lookup table; and S2: controlling a light emitting device to emit light according to the current signal;

wherein the light emitting device comprises a blue light emitting element for emitting blue light and a green light emitting element for emitting green light, the color temperature lookup table comprises a color temperature value, a ratio of a current flowing through the green light emitting element to a current flowing through the blue light emitting element; and the S2 further comprises: based on the current signal, applying the corresponding currents respectively to the green light emitting element and blue light emitting element to emit light.

2. The color temperature tuning method according to claim 1, wherein before the step S1, the method further comprises a step of:

S0: creating a color temperature lookup table.

3. The color temperature tuning method according to claim 2, wherein the step S0 comprises steps of:

S01: establishing a calculation formula of a relationship between the current and the color temperature value by controlling the current applied to the light emitting device and measuring color temperature value corresponding to the current; and S02: establishing the color temperature lookup table according to the calculation formula.

4. The color temperature tuning method according to claim 3, wherein the calculation formula is:

$$T(k)=[t_6\times k^6-t_5\times k^5+t_4\times k^4-t_3\times k^3+t_2\times k^2-t_1\times k+t_0],$$

where k denotes a ratio of a current flowing through a green light emitting element of the light emitting device to a current flowing through a blue light emitting element of the light emitting device, $k=I(G_{chip}):I(B_{chip})$, $0.25\leq k\leq 2$, $t_0$~$t_6$ denotes coefficients of 0-6 order exponentials of k, $I(G_{chip})$ denotes a current flowing through the green light emitting element of the light emitting device, $I(B_{chip})$ denotes a current flowing through the blue light emitting element, and T(k) denotes the color temperature value corresponding to k.

5. A color temperature tuning apparatus for performing the color temperature tuning method according to claim 1, the color temperature tuning apparatus comprising:

a color temperature controlling device for controlling the input color temperature signal and a light emitting device for emitting light according an output signal of the color temperature controlling device, wherein the color temperature controlling device is connected with the light emitting device; and the light emitting device comprises a light emitting unit, and the light emitting unit comprises a blue light emitting element for emitting blue light and a green light emitting element for emitting green light;

the color temperature controlling device comprises a color temperature lookup table unit for matching the color temperature signal with the color temperature value in the color temperature lookup table; the color temperature lookup table unit comprises a color temperature value and a ratio of a current flowing through the green light emitting element to a current flowing through the blue light emitting element; and the color temperature controlling device, based on the corresponding current signal in the color temperature lookup table, which is matched to the input color temperature signal, respectively applies the corresponding currents to the green light emitting element and the blue light emitting element to emit light.

6. The color temperature tuning apparatus according to claim 5, wherein the color temperature controlling device comprises:

a signal receiving unit for receiving the color temperature signal;

a color temperature selection unit for selecting the color temperature value proximate to the color temperature signal from the color temperature lookup table; and a first power supply unit for supplying power to the signal receiving unit, the color temperature lookup table unit and the color temperature selection unit, the signal receiving unit is connected with the color temperature lookup table unit, the color temperature lookup table unit is connected with the color temperature selection unit, the color temperature selection unit is connected with the light emitting device, and the first power supply unit is connected with the signal receiving unit, the color temperature lookup table unit, and the color temperature selection unit, respectively.

7. The color temperature tuning apparatus according to claim 6, wherein the light emitting device comprises:

a current controlling unit for controlling the currents according to the output signal of the color temperature selection unit;

a second power supply unit for supplying power to the current controlling unit and the light emitting unit, the current controlling unit is connected with the color temperature selection unit and the light emitting unit, respectively, the second power supply unit is connected with the current controlling unit and the light emitting unit, respectively.

8. The color temperature tuning apparatus according to claim 7, wherein the second power supply comprises a first current output terminal and a second current output terminal.

9. The color temperature tuning apparatus according to claim 7, wherein the light emitting unit is a LED.

10. The color temperature tuning apparatus according to claim 9, wherein the LED comprises the blue light emitting element for emitting blue lights and a green light emitting element for emitting green lights, the blue light emitting element and the green light emitting element are connected with the first current output terminal and the second current output terminal, respectively.

11. The color temperature tuning apparatus according to claim 10, wherein the LED comprises a red fluorescent powder.

12. A display apparatus comprising a color temperature tuning apparatus for performing the color temperature tuning method according to claim 1, the color temperature tuning apparatus comprising:

a color temperature controlling device for controlling the input color temperature signal and a light emitting device for emitting light according an output signal of the color temperature controlling device, wherein the color temperature controlling device is connected with the light emitting device; and the light emitting device comprises a light emitting unit, the light emitting unit comprises a blue light emitting element for emitting blue light and a green light emitting element for emitting green light;

the color temperature controlling device comprises a color temperature lookup table unit for matching the color temperature signal with the color temperature value in the color temperature lookup table; the color temperature lookup table unit comprises a color temperature value and a ratio of a current flowing through the green light emitting element to a current flowing through the blue light emitting element;

the color temperature controlling device, based on the corresponding current signal in the color temperature lookup table, which is matched to the input color temperature signal, respectively applies the corresponding currents to the green light emitting element and the blue light emitting element to emit light.

13. The display apparatus according to claim 12, wherein the color temperature controlling device comprises:

a signal receiving unit for receiving the color temperature signal;

a color temperature selection unit for selecting the color temperature value proximate to the color temperature signal from the color temperature lookup table; and a first power supply unit for supplying power to the signal receiving unit, the color temperature lookup table unit and the color temperature selection unit, the signal receiving unit is connected with the color temperature lookup table unit, the color temperature lookup table unit is connected with the color temperature selection unit, the color temperature selection unit is connected with the light emitting device, and the first power supply unit is connected with the signal receiving unit, the color temperature lookup table unit, and the color temperature selection unit, respectively.

14. The display apparatus according to claim 13, wherein the light emitting device comprises:

a current controlling unit for controlling the currents according to the output signal of the color temperature selection unit;

a second power supply unit for supplying power to the current controlling unit and the light emitting unit, the current controlling unit is connected with the color temperature selection unit and the light emitting unit, respectively, the second power supply unit is connected with the current controlling unit and the light emitting unit, respectively.

15. The display apparatus according to claim 14, wherein the second power supply comprises a first current output terminal and a second current output terminal.

16. The display apparatus according to claim 14, wherein the light emitting unit is a LED.

17. The display apparatus according to claim 16, wherein the LED comprises the blue light emitting element for emitting blue lights and a green light emitting element for emitting green lights, the blue light emitting element and the green light emitting element are connected with the first current output terminal and the second current output terminal, respectively.

18. The display apparatus according to claim 17, wherein the LED comprises a red fluorescent powder.

* * * * *